United States Patent [19]

Elsworth

[11] 4,254,806

[45] Mar. 10, 1981

[54] APPARATUS FOR FILLING CAULKING TUBES IN A CLEAN MANNER

[75] Inventor: Robert M. Elsworth, Mail Box 19, Georgetown, Exuma, The Bahamas

[73] Assignee: Robert M. Elsworth, Loudonville, N.Y.

[21] Appl. No.: 33,113

[22] Filed: Apr. 25, 1979

[51] Int. Cl.[3] ..... B65B 3/04

[52] U.S. Cl. ..... 141/116; 141/129; 222/380

[58] Field of Search ..... 137/312; 141/18, 115, 141/116, 117, 119, 126, 127, 311 A, 392, 129; 222/380, 383, 334, 571

[56] References Cited

U.S. PATENT DOCUMENTS

| | | | |
|---|---|---|---|
| 2,103,817 | 12/1937 | Johnson | 141/116 |
| 3,817,300 | 6/1974 | Donnet | 141/117 |

*Primary Examiner*—Frederick R. Schmidt
*Attorney, Agent, or Firm*—E. P. Koltos

[57] ABSTRACT

An apparatus for filling caulking tubes in a clean manner with a liquid viscous composition wherein in the passage tube from which the viscous composition passes into the caulking tube there is attached a suck-back means comprising an air activated piston in a cylinder piston in a cylinder which retracts away from the passage tube when material is not being forced into the caulking tube so as to create a suction effect on the material in the passage tube and prevent it from leaking from the passage tube.

11 Claims, 3 Drawing Figures

APPARATUS FOR FILLING CAULKING TUBES IN A CLEAN MANNER

BACKGROUND OF THE INVENTION

The present invention relates to an improved apparatus for filling caulking tubes and more particularly the present invention relates to an improved apparatus for filling caulking tubes where the liquid viscous composition such as a one-component room temperature vulcanizalbe silicone rubber composition does not drip on the caulking tubes.

Caulking tubes are well known. Such caulking tubes generally comprise a cylinder to which is fitted a protruding nozzle and on the back end of the cylinder there is a cap or plunger part. When it is desired to utilize the caulking tube, the tip of the nozzle of the caulking tube is cut and the caulking tube is put in a plunger gun such that the piston on the gun pushes on the plunger on the rear end of the cylinder and forces the material in the caulking tube outside of the caulking tube. Such caulking tubes are usually used to package materials which it is desired to prevent from contact with moisture or to protect from the weather or the elements prior to use. As can be envisioned in a large manufacturing establishment, it would be tedious and time consuming to fill such caulking tubes with the desired composition by hand. Accordingly, there has been developed different types of machinery for filling such caulking tubes automatically.

Such machinery for filling caulking tubes automatically generally comprises a drive means which drives a conveyor belt on which are located the empty caulking tubes. Drive means also drives linkages which further drives a feeding arrangement at the upper portion of the frame of the machine. The composition or liquid viscous composition is located in reservoirs on the top of the frame of the machine and is fed by pressure into the cavities in a shaft means which rotates in a block means. These compositions are then forced by a suction effect into a piston and cylinder means adjacent to the block and core or shaft means. The piston moves in the cylinder by the desired amount of travel so that a measured quantity of material is inserted into the cylinder. With the desired drive means the shaft with cavities is then rotated such that the cavities are presented in a slightly different direction and the piston is activated such that the measured amount of material in the cylinder is forced by the piston to the cavities in the shaft means through passage tubes down into the empty caulking tubes.

As can be appreciated, the piston and cylinder means through which the material passes, as well as the shaft and block means and specifically the rotation of the shaft means, as well as the synchronization of the caulking tubes, is carried out in the apparatus by appropriate drive and linkage means such that everything is in timed relation with respect to the movement of the different components that were mentioned above.

There was some disadvantages in such prior art machines. One disadvantage is that once the measured amount of material passed into the caulking tube and the caulking tube was filled to the desired height, the material would still leak out of the passage tube and would fall about the sides of the caulking tube or on the conveyor belt, thus creating a very dirty appearance in the apparatus. However, more importantly, amounts of the composition would fall on the caulking tubes and would create a dirty and unsightly appearance on the caulking tubes. As can be appreciated, in the case where a low viscosity composition was being utilized to fill the caulking tubes, this problem was even more widely evidenced. However, even with liquid viscous compositions this dripping effect was quite pronounced.

Accordingly, it was common in the past in such apparatus for automatically filled caulking tubes to have a clean up team of people who would take each caulking tube and wipe it clean before it was packaged, since a dirty caulking tube would create an unsightly appearance and would not be bought by the consumer and would thus have to be sold at a discount or thrown away.

Accordingly, as stated previously, it was common in the prior art caulking tube filling machines, especially with the filling of low viscosity compositions, that there be a clean up crew for cleaning the caulking tubes and for cleaning the apparatus from the dripping of composition from the passage tubes that filled the caulking tubes. Such clean up crews resulted in undesired manual labor being present in the automatic caulking tube filling operation, thus creating undesirable costs in what was essentially an automated operation.

It should be noted that while the instant invention is further directed to a caulking tube machine for filling caulking tubes with silicone compositions, that the improved caulking tube filling machine of the instant invention could be utilized to fill caulking tubes with other compositions such as, butanol, petroleum compounds, honey (in jars), putty and mayonnaise (in jars).

Accordingly, as should be noted, this phenomenon of the material dripping from the passage tubes onto the caulking tubes and onto the conveyor belt of the apparatus thus creating a clean up problem was evidenced not only in the packaging of silicone compositions but also in the packaging of the other compositions disclosed above, as well as other compositions which have not been specified above since such different compositions are too numerous to mention.

Accordingly, it was highly desirable to develop a means in a caulking tube apparatus for eliminating such dripping or dirtying of the caulking tubes by material dripping from the passage tube onto the caulking tube or the conveyor belt or other parts of the machinery.

Accordingly, it is one object of the present invention to provided for improvement in an apparatus for filling caulking tubes where the improvement results in elimination of dripping of the material being filled in the caulking tube.

It is another object of the present invention to provide for an improved caulking tube filling machine where a means is provided to prevent the material from dripping onto the caulking tubes.

It is an additional object of the present invention to provide for an improved caulking tube filling machine which fills the caulking tubes in a clean manner.

This and other objects of the present invention are accomplished by means of the apparatus disclosed in the foregoing figures.

FIGURES

SUMMARY OF THE INVENTION

Figure 1:
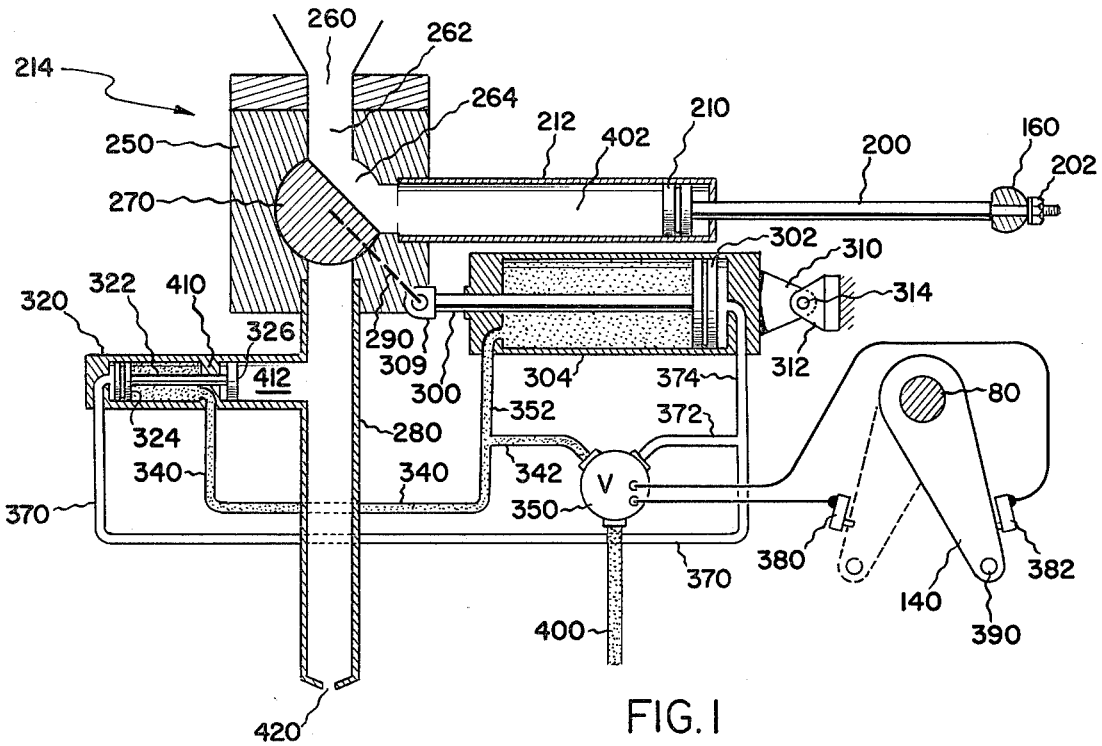
FIG. 1 is a partially skematic/partially front view of the improved caulking tube filling machine of the present invention.

There is provided in accordance with the above objects an improved apparatus for filling caulking tubes with a liquid viscous composition without having the composition drip onto the caulking tube, comprising, a frame; a drive means at the lower portion of said frame; a driving conveyor belt means which conveyor belt means passes through the lower portion of said frame carrying a plurality of caulking tubes which are initially empty; a reservoir means at the top portion of said frame having therein stored said composition; linkage means driven by said drive means and extending from said lower portion of said frame to the upper portion of said frame; valve block means located beneath said reservoir means on said frame, and containing therein valve core means with cavities for receiving said composition; first cylinder and piston means located adjacent to said valve block and valve core means; a passage tube located beneath said block means and attached to said block means, wherein said linkage means drives the valve core means in said first piston means to receive measured quantities of said liquid viscous composition from said reservoir means and deposit the measured quantity in said empty caulking tubes passing on said conveyor belt by passing through said passage tube under the block means and suck-back means located in said passage tube which relieves internal tube pressure and prevents the composition from dripping out of said passage tube when the caulking tubes are not being filled.

It should be noted that preferably the instant apparatus is utilized for filling caulking tubes with silicone composition. Most preferably, the silicone compositions are one-component room temperature vulcanizable silicone rubber compositions. However, the instant apparatus can be utilized, and more specifically the instant improvement in the caulking tube filling apparatus, can be utilized in any caulking tube machine for filling any material in caulking tubes or jars and specifically in apparatus for filling caulking tubes with a low viscosity material, such as low viscosity oils or creams.

Accordingly, the caulking tube filling machine of the instant case can be utilized to fill caulking tubes with any liquid materials having a viscosity varying from 10 to 1,000,000 centipoise viscosity at 25° C. or more, such as up to 10,000,000 centipoise viscosity at 25° C.

DESCRIPTION OF THE PREFERRED EMBODIMENT

It should be noted that the present invention has been devised for packaging silicone compositions in caulking tubes. However, there is no reason why the caulking tube filling apparatus of the present invention need be limited to filling only silicon compositions. The suck-back improvement of the instant case can be utilized with caulking tube or container filling machines where the compositions that are filled are any liquid composition generally having a viscosity varying anywhere from 10 centipoise to 1,000,000 centipoise at 25° C. Examples of compositions other than silicone compositions which can be utilized with the improved caulking tube or container filling machine of the instant case are, for instance, greases, putties, butanols, petroleum products, honey, mayonnaise and jellies.

In one preferred embodiment of the instant case, the improved caulking tube filling apparatus of the instant case is utilized to fill silicone compositions in caulking tubes and more specifically one-component room temperature vulcanizalbe silicone rubber compositions in caulking tubes. Generally, such one-component room temperature vulcanizable silicone rubber compositions are prepared and stored in the absence of moisture. When they are exposed to atmospheric moisture, the composition cross-links and cures to a silicone elastomer in a period of 24 hours.

Examples of such one-component room temperature vulcanizable silicone rubber compositions are, for instance, generally such compositions containing a base polymer composed of a silanol-terminated diorganopolysiloxane polymer having a viscosity varying from 10 centipoise to 1,000,000 centipoise at 25° C., where the organo groups are monovalent hydrocarbon radicals. To this base polymer there may be added a reinforcing filler such as, fumed silica or precipitated silica, or an extending filler such as, lithopone, zinc oxide and iron oxide and etc. Most preferably, a reinforcing filler is used by itself such as, fumed silica either by itself or with an extending filler. To these two mixtures of ingredients there may then be added a cross-linking agent which may be a carboxyl functional silane or a hydrocarbonoxy functional silane. Generally, if it is a carboxyl functional silane, the cross-linking agent will be a methyltriacetoxysilane, and as a catalyst, a tin salt of a carboxylic acid. It should be noted that generally any metal salt of a carboxylic acid with a metal varying from lead to manganese in the Periodic Table may be utilized. However, more preferably, there is utilized a tin salt of a carboxylic acid as a catalyst. Accordingly, the methyltriacetoxysilane and the tin salt of a carboxylic acid such as, dibutyl tin dilaurate or dibutyl tin oxide are mixed into the other two ingredients. Then various other ingredients may be added such as, silylisocyanurates as adhesion promoters, and the resulting composition mixed and stored in the absence of moisture. Such composition is stored in caulking tubes in the absence of moisture which caulking tubes are filled by an apparatus such as the one disclosed in the instant case. When it is desired to cure the composition, the seal in the caulking tube is broken, the composition is applied and exposed to atmospheric moisture, and the composition fully cures into a silicone elastomer in approximately 24 hours.

In the case when there is utilized a hydrocarbonoxy functional silane as a cross-linking agent, there may be utilized methyltrimethoxysilane as a cross-linking agent with a tin salt of a carboxylic acid but more preferably with a titanium chelate. An example of such a composition is, for instance, to be found in the patent of Beers, U.S. Pat. No. 4,100,129, which disclosure is hereby incorporated by reference.

It should be noted that the instant compositions that may be packaged by the machine of the instant invention are not limited to the alkoxy functional and the acyloxy functional compositions that have been disclosed above, such compositions having been disclosed above being only representative. There may be packaged any type of one-component room temperature vulcanizable silicone rubber compositions with the instant improved caulking tube filling apparatus of the instant case. The compositions disclosed above are only representative of such compositions, and are given as an exemplification and illustration of such compositions.

According to the Figures, FIG. 1 is a front view of the caulking tube filling apparatus of the instant case. Generally, such apparatus comprises a platform (10) to which is appended a base (12) and the sides (14), (16) and (18) and the top (24) of frame (26) of the apparatus of the instant invention. On platform (10) there is also supported platform (28) on which is located motor (32) which drives the gears in gear boxes (36) which drives the main drive shaft (40) which passes through sides (14), (16) and (18) of frame (26) supported in sides (14) and (16) by brackets (42) and (44). Main drive shaft (40) turns in sides (14), (16) and (18) through bearing surfaces not seen in FIG. 1, on side (14) and through bearing surface (50) partially seen on side (16) and through bearing surfaces (52) and (54) on side (18) of frame (26). At the end of main drive shaft (40) there is a conveyor drive chain sprocket (60) which is retained on main drive shaft (40) by the proper retaining collars and keyway which are seen in the drawing and will not be indicated by numbers. Any suitable retaining collars may be utilized to retain the sprocket (60) on main drive shaft (40).

Main drive shaft (40) drives an eccentric cam which cannot be seen which rotates in cam follower (70) which cam follower (70) provides a rocking motion to drive lever (72) which is attached by a yoke (74) to rocker arms (76) and (78) which are retained on secondary drive shaft (80) by retained members (82), (84) and (86). Secondary drive shaft (80) rides on sides (16) and (18) through bearing surfaces (90), (92), (94) and (100) which are shown in FIG. 1, along with the proper retaining rings and keys which have not been numbered in FIG. 1, since they are such obvious appendages to such apparatus. Yoke (74) rides on shaft (104) which is retained on sides (16) and (18) by bearing surfaces (110) and (112) as is indicated.

The function of yoke (104) is to properly transmit a rocking motion to secondary drive shaft (80) and through rocker arms (76) and (78) and also to function along with shaft (104) as an adjusting means for adjusting the amount of travel of rocker arms (76) and (78) and thus the amount of reciprocal rotation in the secondary drive shaft (80) which controls the amount of material that is filled into the caulking tubes as will be obvious from the description hereunder. However, such does not form any part of the present invention and such it will not be discussed in detail.

Secondary drive shaft (80) also rides in bearing surfaces (120) on side (14) as can be seen with the appropriate retaining collars on such shaft to prevent its lateral motion with respect to side (14) of frame (26). By means not shown in the drawing, main drive shaft (40) drives conveyor belt (130) on which are receptacles (132) in which are placed empty caulking tubes (134) for being filled by the apparatus of the instant case. The conveyor belt (130) moves from the viewer into the plane of the drawing of FIG. 1, as should be noted. Again the movement of the conveyor belt, the receptacles and the empty caulking tubes (134) form no part of the instant invention, except in a secondary manner. Secondary drive shaft (80) drives rocker arms (140) and (142) in a reciprocating motion which rocker arms (140) and (142) are retained on secondary drive shaft (80) by retaining keys and collars (144) (146), (148) and (150), respectively. Rocker arms (140) and (142) drive and are connected to, by appropriate lever means, cylinder (160) and drive cylinder (160) in a reciprocating motion which is kept from deviating from the prescribed and desired motion by (170) and (172) which fit in slots (180) and (182) in channel members (190) and (192) which is attached to sides (14) and (16) of frame (26), respectively. Cylinder (160) has six rods (200) attached (which can be better seen in FIGS. 2 and 3) which are bolted to cylinder (160) through nuts (202). Rod (200) motivates piston (210), rides on cylinder (212) attached to block and valve core means (214) such that a measure of quantity of material flows from reservoirs (216) and (218) into cylinder (212) and into the caulking tubes as will be explained herein below. However, before going into the description of the valve core and block means in the preferred invention of the instant case, it is necessary to mention the reservoir means. The reservoir means comprises an eliptical base, cylindrical top structure (220) and (222) on which are circular tops (224) and (230) which eliptical base structures (220) and (222) are welded to rectangular plates belted to and resting on support plates (250) and (252) supported by sides (14) and (16).

The eliptical reservoir base welded to the rectangular mounting base and flaring up into a circular shape and welded to a cylinder reservoir section is thus strong enough (with a proper thickness of wall structure) to withstand internal pressures required to force the viscous material through the reservoir base cavities, through the support plate cavities, through the valve block cavities and into the metering fill pistons. Whereas this flow is assisted by the suction action of the fill piston it must be recognized that the internal pressures should exceed atmospheric pressure to prevent moisture containing air from leaking into the process, as might occur if cavitation were allowed.

With this explanation it now becomes apparent for practical and economical reasons the fill reservoir must be kept as small as possible to serve only as a level control device to regulate up-stream in-feed to the filling machine as is done by a level sensing probe in the reservoirs or the filling machine.

Two small reservoirs are much more desirable than one reservoir capable of covering five or more openings to supply five or more filling tubes.

Level sensing probes can be in each reservoir controlling valves up-stream replacing fill material as required or the material can be fed through the first reservoir through a connecting pipe into a second reservoir or more with the last reservoir containing the level or in-feed control. If the last reservoir is maintained with a proper level of material all other reservoirs (all sealed) in series supplying the last one will be sufficiently filled. The multiple smaller reservoirs require less expensive material and are more easily cleaned for color or product changes.

Figure 2:
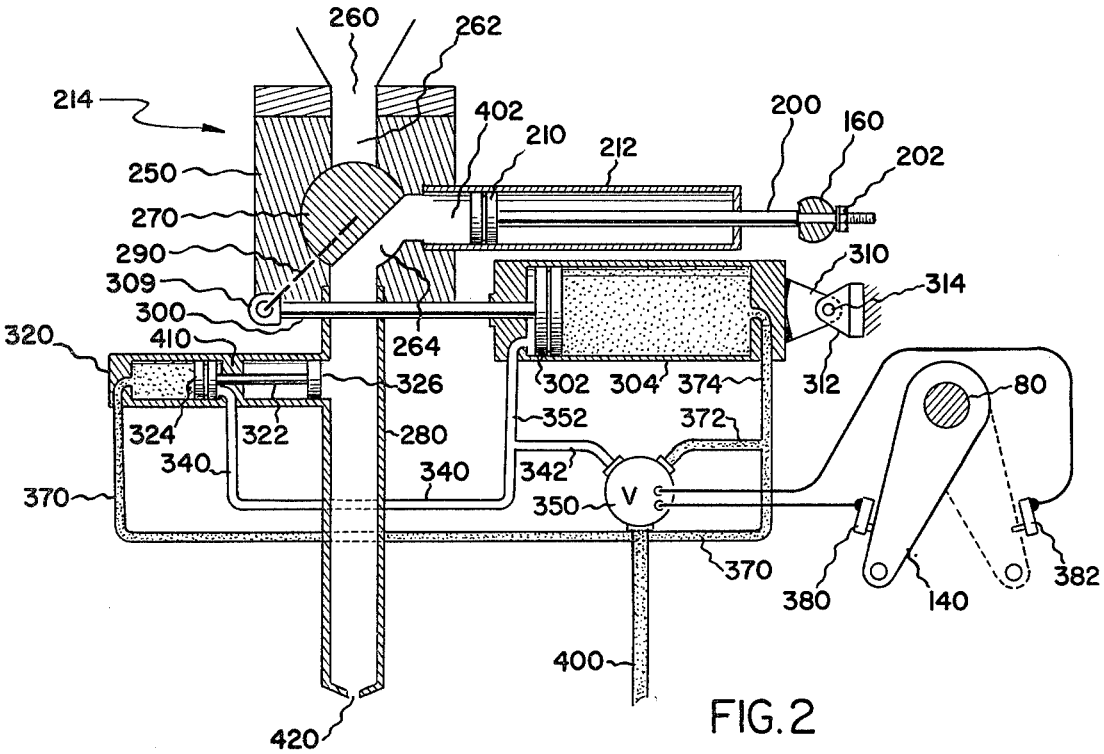
FIG. 2 is a partially skematic/partially cross-sectional view of the improved means for preventing dripping of the composition being filled onto the caulking tubes showing the apparatus when the measured amount of material is inserted into the piston and cylinder when a caulking tube is not being filled.
Figure 3:
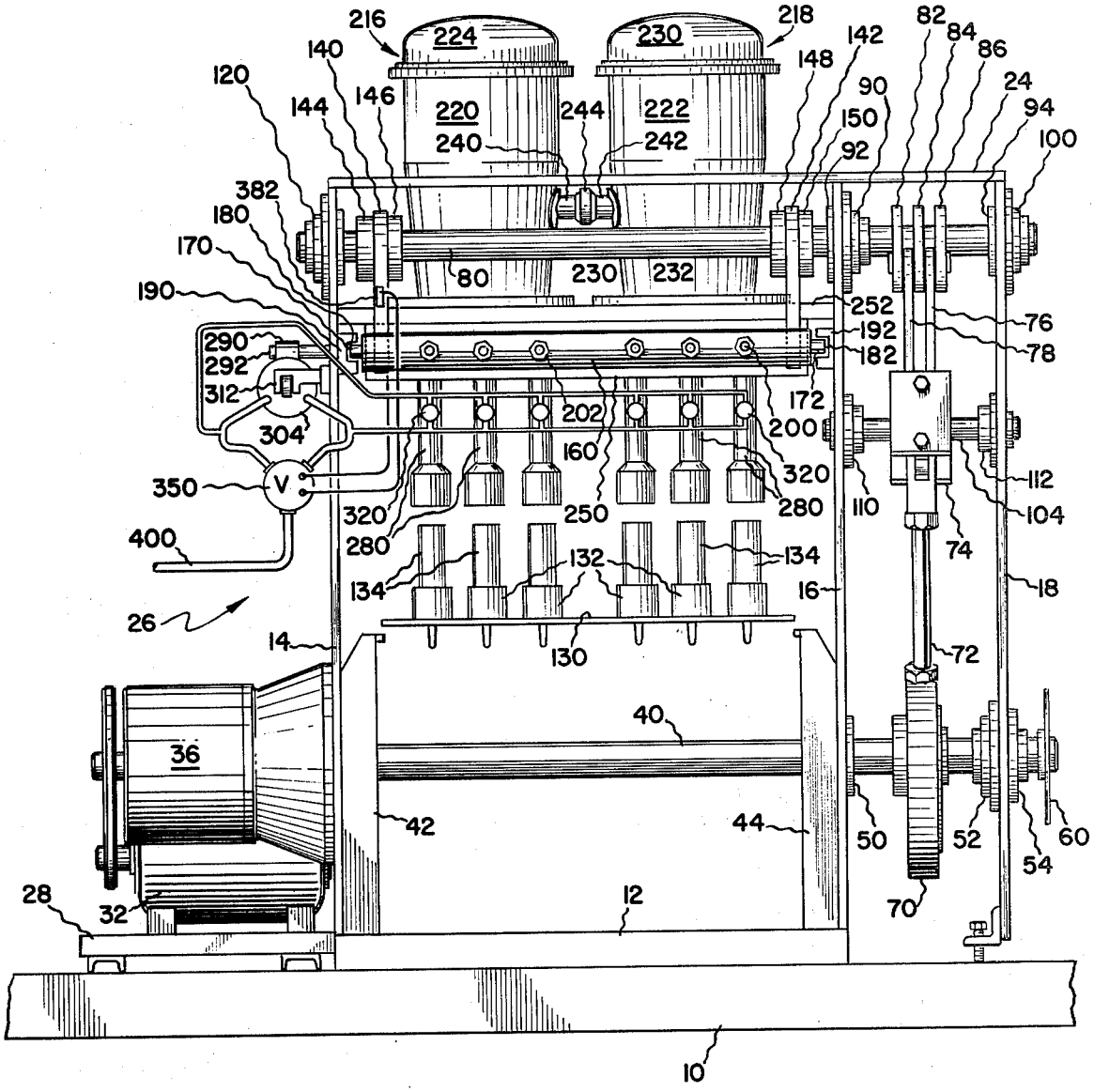
FIG. 3 is a partially skematic/partially cross-sectional view of the means of the present invention for preventing the composition being filled from dripping onto the caulking tubes showing the position of the apparatus when the caulking tube is being filled.

Proceeding to FIGS. 2 and 3, but still following FIG. 1, it is seen that from the reservoir (216), for instance, that silicone composition flows into block (250) of valve block and valve core means (214). Block (250) is made up in two parts and has a retaining plate or fastening plate (252) for maintaining the two blocks together. However, this is not pertinent to the instant invention and has not been shown in detail in the instant case.

Silicone composition or other compositions flow from reservoir (216) through opening (260) in plate (252) and through channel (262) in block (250) and through a cavity (264) in core (270). It should be noted that core or pallet (270) comprises a cylindrical shaft which has cavities cut out in the manner shown in FIGS. 2 and 3, at the place where they are located are cylinders (212) and pistons (210). In the present apparatus of the instant invention there are six such pistons (212) and cylinders (210) and rods (200) which are appended to cylindrical bar (160). As stated previously, core shaft (270) is a cylindrical shaft with cavities (264) cut out at the appropriate places so that silicone compositions or other compositions can pass into cylinder (212), when core (270) is at the proper rotation point. At the bottom of block (250) there is a passage tube (280). There are six such passage tubes and there are six such cavities (264) in core (270) and six cylinders (212) and piston (210) and rods (200) for filling six caulking tubes at one time with the caulking filling machine of the present invention.

As can be appreciated, an apparatus can be produced with capabilities for filling less than six caulking tubes or more than six. However, no machine at this time has evolved, as far as is known, which will fill more than six caulking tubes at one time with this material. Core (270) is attached by means (not shown) in FIGS. 2 and 3, but partially shown in FIG. 1, that is, a lever (290) attached to core shaft (292), as can be seen in FIG. 1. Lever (290) and core shaft (292) is driven by rod (300) of air piston cylinder (302) moving in air cylinder (304). Air cylinder (304) is affixed by bracket (310) on yoke (312) by pin (314) as can be seen in FIGS. 2 and 3, and also as can be seen in FIG. 1. Yoke (312) appended to bracket (310) through pin (314) of air cylinder (304) can also be seen in FIG. 1. It should be understood that FIGS. 1, 2 and 3 are partly skematic and do not necessarily show the proper location in the apparatus of FIG. 1, all of the component parts.

In passage tube (280) there is about a quarter of the distance down from block (250), an air cylinder (320) to which air piston (322) moves with two heads (324) and (326). Air cylinder (320) is connected by air passageway (340) and (342) to four-way valve (350). Air cylinder (320) is connected to air cylinder (304) through air passageway (340) and (352). it should be noted that the air piston (302) and air cylinder (304) has rod (300) to which is appended bracket (309) which is connected, as pointed out previously, to core shaft (270). In addition, in the latter portion of air cylinder (320), air cylinder (320) is connected by air passageway (370) and (372) to four-way valve (350) and by passageways (370) and (374) to air cylinder (304) or to the back portion of air cylinder (304). Four-way valve (350) is actuated by electrical current brought from contacts (380) and (382) as they are contacted by rocker arm (140). It should be noted that lower point (390) or rocker arm (140) is connected to cylinder (160) through the appropriate connecting means which are not shown here since it was not felt necessary to do so in explaining the instant invention.

Accordingly, in the operation of the instant invention, rocker arm (140) as it moves to the positions shown in FIG. 2, contacts electrical contacts (380) and (382). This motivates four-way valve (350) such that air passage comes in through air supply line (400) through line (342) and (352) into the left side of air cylinder (304) as one looks into the plane of FIG. 2. This causes piston (302) to move to the right causing appending point connection (309) to swing through the appropriate connecting rod, as explained previously, and more shaft core (270) such that channel (264) opens up. When channel (264) opens up material from reservoir (216) flows by forced pressure feed through cavity (264) and also by the suction created by piston (210) in cylinder (212) into the cavity (402) in cylinder (212) as piston (210) moves to the right.

It should be noted since rocker arm (140) moves to the right and it is connected at lower point (390) on cylinder (160) that the movement will be synchronized. Piston (210) is adjusted to move in space (402) in cylinder (212) to the desired degree such that the desired measured quantity of material is forced in cavity (402) of cylinder (212). As air pressure passes from four-way valve (350) through passageways (342) and (352) into cylinder (304) air passes also along passageways (340) and (342) by means of four-way valve (350) into the space between heads (324) and (326) and to the left of partition (410) so as to cause head (324) to move to the left looking into the plane of FIG. 2. This causes piston head (326) to retract from opening (412), in passage tube (280) creating a suction effect for flow of the material into cavity (412) in air cylinder (320). This causes material from opening (420) of passageway (280) to flow upward and accordingly prevents dripping of the composition from opening (420) of passage tube (280) while the cavity (402) in air cylinder (212) is being filled and also while a new set of caulking tubes are being presented or moved into place by conveyor belt (130) below passage tubes (280) by a general synchronization of parts which is well known to one skilled in the art. Once the travel of rocker arm (140) has been completed to the right, rocker arm (140) travels to the left (as seen in FIG. 3) which causes cylinder (160) to move to the left which causes rod (200) and piston (210) to move in cylinder (212) to the left. also, rocker arm (140) activates electrical lead (380) which activates the four-way valve (350) such that air is forced from air supply line (400) through passageway (372) and (374) into the right of piston ((302) to force piston (302) to the left. As this happens, connecting bracket (309) moves to the left and accordingly, as explained previously, by the appropriate connecting core shaft means (270) rotates in a clockwise direction such that cavity (264) in core shaft (270) presents an opening between filled space (402) in cylinder (212) and the opening in passage tube (280).

Accordingly, through the action of piston (210) and cylinder (212) material is forced out of piston (210) and filled space (402) through cavity (264) through passage tube (280) out of opening (420) into the empty caulking tube waiting underneath opening (420). Accordingly, at the same time as when piston (210) moves to the left in cylinder (212) to force material out of cylinder (212) into passage tube (280) out of opening (420) into the empty caulking tube, air is forced through passage way (372) and (370) into the rear of air piston (324). A four-way valve allows air through air supply line (400) to pass through line (370) and (372) into the left of piston head (324) and (326) causing the piston head (324) and (326) to move to the right, (FIGS. 2 and 3), against partition (410) and so as to close up the the opening (412) in cylinder (320). Accordingly, this eliminates any backward pressure or suction in passage tube (280) in the position shown in FIG. 3 and allows the full measured quantity of material to flow from cylinder (212) into passage tube (280) out of opening (420) into the empty caulking tube. Then the rocket arm (140) moves to the direction shown in FIG. 2 to begin the cycle once again. All this is done in synchronization as is well known to one skilled in the art so that the appropriate passageways will be opened by the time piston (210) moves in cylinder (212) either to the right or left.

As can also be envisioned, it is well known to one skilled in the art to adjust the rocker arm (140) travel in the apparatus of the instant case such that cylindrical shaft (160), rod (200) and piston (210) move in cylinder (212) the appropriate amount so that the desired amount of material gets forced out of cylinder (212) into passage tube (280) and out of opening (420) into the empty caulking tube. By utilizing the appropriate adjusting means which is well known to one skilled in the art, it is possible to fill a caulking tube within 0.0 to 0.5% by weight of the desired weight consistently. By utilizing the invention as shown and discussed above, it is possible to fill caulking tubes with silicone composition and other compositions including low viscosity compositions without material dripping out of opening (420) in passage tube (280) while a full caulking tube is being taken away from a point below passage tube (280) and a new empty caulking tube be presented to the point below passage tube (280).

The invention of the instant case thus eliminates dirty and unsightly caulking tubes and apparatuses and eliminates the necessity for clean up operations and clean up crews.

Accordingly, the invention of the instant case results in less discarded material, less lost sales and less labor costs in terms of eliminating the need for a clean up crew to carry out clean up operations with respect to the caulking tubes in the filling machine.

By a simple means the modification of the instant case improves caulking tube filling machines so as to eliminate undesirable labor costs in the cleas up of caulking tube machines and caulking tubes that was necessary with the prior caulking tube filling machines which caused the caulking tubes in many cases to come out from the apparatus in a dirty and unsightly manner and which caused the prior art caulking tube filling apparatus to become dirty prematurely requiring extensive cleaning up operations.

I claim:

1. The filling portion of an apparatus for filling caulking tubes such that filling caulking tubes with a liquid composition such that the filling portion of the apparatus prevents material from leaking onto the caulking tubes so as to dirty the caulking tubes when material is not being forced into the caulking tubes, comprising a frame;

a drive means located on the lower portion of said frame;

reservoir means located on the upper portion of said frame having therein stored a liquid composition;

blocks means located beneath said reservoir means and valve core means within said block means, said valve core means comprising a cylindrical shaft with cavities or passageways in said shaft for the passage of said liquid composition from said reservoir means through said block means and said valve core means;

first piston and cylinder means located adjacent to said block means receiving measured quantities of said liquid composition from said reservoir means through said block and valve core means, said first piston means and said valve core means being activated by said drive means;

passage tube means located beneath said block means for allowing measured quantities of said material to pass from said first cylinder and piston means through the cavities or passageways in said valve core means into said passage tube into empty caulking tubes;

suck-back means located on such passage tube means for preventing material from leaking out of said passage tube means when material is not being forced into caulking tubes, second and third piston and cylinder means which are activated by said drive means and which drive said suck-back means through a second valve means; and wherein said suck-back means comprises said third piston and cylinder means comprising a horizontal tube perpendicularly connected to said passage tube means having therein a suck-back piston such that when the suck-back piston is activated by air pressure through said second piston and cylinder means by means of said second valve means to retract in a direction away from said passage tube when the material is not forced through such passage tube into said caulking tubes so that there is created a suction effect in such passage tube so as to prevent said composition from leaking out downward from said passage tube means and where said second valve means causes air pressure to force said suck-back piston and said third piston and cylinder means such that said suck-back piston is forced by said third piston and cylinder means so as to eliminate the suction effect when the composition is being forced through said passage tube into said caulking tubes.

2. The apparatus of claim 1 wherein said second piston and cylinder means are air cylinder and piston means activated by said second valve means which forces said valve core means to open a passageway from said reservoir means to said first piston and cylinder means such that measured quantities of said composition can flow into said first piston and cylinder means through the cavities in said valve core means and such that when this is going on said second valve means activates said third piston and cylinder means such that said suck-back piston through air pressure is forced to retract away from said passage tube so as to cause a suction effect in said composition in said passage tube to prevent the composition from leaking out of said passage tube.

3. The apparatus of claim 2 wherein said second valve means is a four-way valve means activated by a second linkage means which is driven by a first linkage means which is driven by said drive means for varying the direction said air flow in said second and third air piston and cylinder means.

4. The apparatus of claim 3 wherein said second valve means is a four-way valve means which is opened such that said second valve means activates the valve core means and said first linkage means activates said first piston and cylinder means adjacent thereto so as to force measured quantities of said composition from said first piston and cylinder means through such passage tube means into said empty caulking tubes, and air pressure activates the suck-back piston in said third air piston and cylinder means such that it moves towards the passage tube and such that there is no longer created any suction effect on said composition in said passage tube so as to prevent it from leaking, or being forced through said passage tube into said empty caulking tubes.

5. An improved apparatus for filling caulking tubes with a liquid composition without having the composition drip on the caulking tube, comprising a frame, a drive means at the lower portion of said frame driving conveyor belt means which conveyor belt means passes through the lower portion of said frame carrying a plurality of caulking tubes which are initially empty; Z reservoir means at the top portion of said frame having therein stored said composition;

first linkage means driven by said drive means and extending from said lower portion of frame to the upper portion of said frame;

valve block means located beneath said reservoir means on said frame and containing therein valve core shaft means with cavities for receiving said composition;

first piston and cylinder means located adjacent to said valve block and valve core shaft means;

a passage tube located beneath said block means and attached to said block means, wherein said first linkage means activates a second linkage means which activates four-way valve means which activates a second and a third air piston and cylinder means, said third air piston and cylinder means having a suck-back piston means and horizontal tube perpendicularly connected to said passage tube which is vertical such that said suck-back piston means is activated by said third air cylinder and piston means so that said suck-back piston is forced toward said passage tube so as to eliminate any suction effect when said composition is being forced through said passage tube into said caulking tubes and such that when sufficient material has been inserted into the caulking tube said second linkage means activates said four-way valve means which activates said second piston and cylinder means to force the valve core shaft means to turn so as to not to allow material to pass to said caulking tube and activates said third piston and cylinder means which activates the suck-back piston to force it to retract away from said passage tube so as to cause a suction on said composition in said passage tube to prevent said composition from leaking out of said passage tube.

6. An improved apparatus for filling caulking tubes with a liquid composition without having the composition drip on the caulking tubes, comprising, a frame;

a drive means at the lower portion of said frame driving conveyor belt means which conveyor belt means passes through the lower portion of said frame carrying a plurality of caulking tubes which are initially empty;

reservoir means at the top portion of said frame having therein stored said liquid composition;

first linkage means driven by said drive means and extending from said lower portion of frame to the upper portion of said frame and driving second linkage means; valve block means located beneath said reservoir means on said frame and containing therein valve core means with cavities for receiving said composition;

first piston and cylinder means located adjacent to said block and core means for receiving therein said composition;

a passage tube located beneath said block means and attached to said block means for allowing said composition to pass there through in said caulking tubes, wherein said first linkage means, drive said valve core means and said first piston and cylinder means to receive measured quantities of said viscous composition from said reservoir means and deposit the measured quantities in said empty caulking tubes passing on said conveyor means, comprising the improvement wherein there is a suck-back means located on said passage tube which prevent the composition from dripping out of such passage tube when said caulking tubes are not being filled, wherein such suck-back means comprises second and third piston and cylinder means which piston and cylinder means are activated by a second valve means which is activiated by said second linkage means and said third piston and cylinder means drive a suck-back piston which is located in a cylinder which is attached to said passage tube horizontally and perpendicularly above the point where said passage tube deposits said composition into said caulking tubes and such that when the piston of said third piston and cylinder means is activated so as to cause said suck-back piston to retract away from said passage tube when composition is not being forced through said passage tube to fill the caulking tubes so as to create a suction on the composition in the passage tube and the said piston in said third piston and cylinder means forces said suck-back piston toward said passage tube to eliminate any suction effect when such composition is being forced through the said passage tube into said caulking tubes and wherein said second piston and cylinder means is activated by said second valve means in timed relation to the movement of said third piston and cylinder means and to the movement of said suck-back piston.

7. The apparatus of claim 6 wherein said second valve means is a four-way valve means which is opened by said second linkage means and where said second valve means and said second linkage means activates said valve core means and said first piston and cylinder means adjacent thereto so as to force measured quantities of said composition from said first piston and cylinder means through said passage tube into said empty caulking tubes where air pressure activates said such-back piston such that it moves toward said passage tube and such that there is no longer any suction effect on said composition on said passage tube to prevent it from leaking.

8. The apparatus of claim 7 wherein there is a plurality of first piston and cylinder means, passage tubes and suck-back means.

9. The apparatus of claim 8 wherein in the apparatus there are two or more first piston and cylinder means, passage tubes and suck-back means such that there is filled six caulking tubes at a time.

10. The apparatus of claim 9 wherein said valve core means comprises a single cylindrical stainless steel cylinder shaft which fits in a bore in said valve blocks means in which said cylindrical shaft has six cut-out cavities for receiving and depositing therefrom said liquid viscous composition.

11. The apparatus of claim 10, wherein said liquid composition is a one-component room temperature vulcanizable silicone rubber composition.

* * * * *